US011773579B2

(12) United States Patent
Giertz et al.

(10) Patent No.: US 11,773,579 B2
(45) **Date of Patent: *Oct. 3, 2023**

(54) WASHING TOILET SEAT

(71) Applicant: Bemis Manufacturing Company, Sheboygan Falls, WI (US)

(72) Inventors: Norman Giertz, Sheboygan Falls, WI (US); Robert Davis, Valders, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/859,773

(22) Filed: Jul. 7, 2022

(65) Prior Publication Data

US 2022/0341145 A1 Oct. 27, 2022

Related U.S. Application Data

(63) Continuation of application No. 16/721,359, filed on Dec. 19, 2019, now Pat. No. 11,421,411.

(Continued)

(51) Int. Cl.
*E03D 9/08* (2006.01)
*A47K 13/24* (2006.01)

(52) U.S. Cl.
CPC ..... *E03D 9/08* (2013.01); *A47K 13/24* (2013.01)

(58) Field of Classification Search
CPC ..... E03D 9/08; A47K 13/24

(Continued)

(56) References Cited

U.S. PATENT DOCUMENTS 3,377,629 A 4/1968 Pasquale
3,577,567 A 5/1971 Wintercorn (Continued)

FOREIGN PATENT DOCUMENTS

CN 108643305 A 10/2018
GB 767062 A 1/1957

(Continued)

OTHER PUBLICATIONS

International Search Report and Written Opinion for Application No. PCT/US2019/067566 dated Mar. 20, 2020 (14 pages).

(Continued)

*Primary Examiner* — Christine J Skubinna
(74) *Attorney, Agent, or Firm* — Michael Best & Friedrich LLP

(57) ABSTRACT

A washing toilet seat assembly includes a toilet seat and a housing configured to be coupled to a toilet bowl to support the toilet seat about a pivot axis. The housing includes a cartridge interface and a cover moveable between an open position allowing access to the cartridge interface and a closed position blocking access to the cartridge interface. The washing toilet seat assembly further includes a cartridge removably coupled to the cartridge interface, the cartridge including a dispensable solution, and a spray wand moveably supported by at least one of the toilet seat or the housing. The spray wand is in fluid communication with the cartridge to dispense the dispensable solution, and the spray want is configured to dispense the dispensable solution during operation of the washing toilet seat assembly as a user sits on the toilet seat.

20 Claims, 8 Drawing Sheets

Related U.S. Application Data

(60) Provisional application No. 62/782,240, filed on Dec. 19, 2018.

(58) Field of Classification Search
USPC ..... 4/443–448
See application file for complete search history.

(56) References Cited

U.S. PATENT DOCUMENTS

| | | | |
|---|---|---|---|
| 3,776,773 | A | 12/1973 | Taft |
| 3,995,326 | A | 12/1976 | Umann |
| 4,000,742 | A | 1/1977 | Digicomo |
| 4,062,072 | A | 12/1977 | Roberts |
| 4,326,308 | A | 4/1982 | Silver |
| 4,371,993 | A | 2/1983 | Patrick |
| 4,441,219 | A | 4/1984 | Epstein |
| 4,510,630 | A | 4/1985 | Osgood |
| 4,553,274 | A | 11/1985 | Yui |
| 4,876,750 | A | 10/1989 | Broyles |
| 4,998,300 | A | 3/1991 | Sharifzadeh |
| 5,027,444 | A | 7/1991 | Tsals |
| 5,097,540 | A | 3/1992 | Lovitt |
| 5,201,080 | A | 4/1993 | Tanaka et al. |
| 5,274,856 | A | 1/1994 | Bernard et al. |
| 5,685,028 | A | 11/1997 | Miller et al. |
| 5,987,659 | A | 11/1999 | Cannizzaro |
| 6,115,854 | A | 9/2000 | Haghayegh |
| 6,470,506 | B2 | 10/2002 | Weber |
| 6,662,379 | B2 | 12/2003 | Nguyen et al. |
| 6,675,405 | B1 | 1/2004 | Harm |
| 6,785,915 | B1 | 9/2004 | Daugherty |
| 6,973,679 | B1 | 12/2005 | Schad |
| 7,013,502 | B2 | 3/2006 | Pacheco |
| 7,055,185 | B1 | 6/2006 | Deveer |
| 7,065,802 | B2 | 6/2006 | Jung |
| 7,120,946 | B1 | 10/2006 | Lazar |
| 7,155,754 | B2 | 1/2007 | Chung |
| 7,191,473 | B2 | 3/2007 | Matsumoto et al. |
| 7,316,038 | B2 | 1/2008 | Egeresi |
| 7,543,339 | B1 | 6/2009 | Harris |
| 7,549,429 | B2 | 6/2009 | Nunomura et al. |
| 7,954,141 | B2 | 5/2011 | De Lutiis et al. |
| 8,095,997 | B2 | 1/2012 | Harris |
| 8,495,770 | B2 | 7/2013 | Koga et al. |
| 9,125,792 | B2 | 9/2015 | Ji et al. |
| 9,168,199 | B2 | 10/2015 | Li |
| 9,212,477 | B2 | 12/2015 | Tiagai |
| 9,428,898 | B1 | 8/2016 | Clements |
| 9,464,425 | B2 | 10/2016 | Bailey |
| 9,822,519 | B2 * | 11/2017 | Hall ..... E03D 9/08 |
| 2003/0070215 | A1 | 4/2003 | Chung |
| 2006/0207007 | A1 | 9/2006 | Fogel |
| 2011/0016620 | A1 * | 1/2011 | Wirz ..... A47K 13/145 4/243.2 |
| 2011/0067728 | A1 | 3/2011 | Chakrabarty et al. |
| 2013/0026250 | A1 | 1/2013 | Burt et al. |
| 2014/0107409 | A1 | 4/2014 | Bailey et al. |
| 2015/0313424 | A1 | 11/2015 | Mas Lara |
| 2017/0030064 | A1 | 2/2017 | Gill |
| 2017/0260728 | A1 | 9/2017 | Hall et al. |
| 2017/0275866 | A1 | 9/2017 | Hashimoto et al. |
| 2017/0275867 | A1 * | 9/2017 | Hashimoto ..... E03D 9/08 |
| 2017/0319794 | A1 * | 11/2017 | Schwab ..... A61M 3/0245 |
| 2017/0321408 | A1 | 11/2017 | Schwab et al. |
| 2018/0002911 | A1 | 1/2018 | Hall et al. |
| 2018/0010324 | A1 | 1/2018 | Culton, Sr. |
| 2018/0028797 | A1 * | 2/2018 | Schwab ..... A61M 3/022 |
| 2018/0036473 | A1 | 2/2018 | Schwab |
| 2018/0070781 | A9 | 3/2018 | Culton, Sr. |
| 2018/0266091 | A1 | 9/2018 | Schmucker et al. |
| 2020/0178738 | A1 * | 6/2020 | Schwab ..... B05B 12/002 |

FOREIGN PATENT DOCUMENTS

| | | | |
|---|---|---|---|
| JP | H0782774 | A | 3/1995 |
| JP | 2000064393 | A | 2/2000 |
| JP | 2001279769 | A | 10/2001 |
| JP | 2004076435 | A | 3/2004 |
| JP | 2006249924 | A | 9/2006 |
| KR | 1020120053814 | A | 5/2015 |
| WO | 2011155718 | A2 | 12/2011 |

OTHER PUBLICATIONS

Chinese Patent Office Action for Related Application No. 201980084294.1 dated Nov. 15, 2022 (22 pages, including an English translation).

Chinese Patent Office Action for Related Application No. 201980084294.1 dated Jun. 21, 2023 (21 pages, including an English translation).

* cited by examiner

WASHING TOILET SEAT

CROSS-REFERENCE TO RELATED APPLICATIONS

This application claims priority to co-pending U.S. patent application Ser. No. 16/721,359, filed on Dec. 19, 2019, and to U.S. Provisional Patent Application No. 62/782,240, filed Dec. 19, 2018, the entire contents of each of which are incorporated herein by reference.

FIELD OF THE INVENTION

The present invention relates to washing toilet seats, and more particularly to washing toilet seats operable to dispense medication or fragrance.

SUMMARY

In one aspect, a washing toilet seat assembly includes a toilet seat and a housing configured to be coupled to a toilet bowl to support the toilet seat about a pivot axis. The housing includes a cartridge interface and a cover moveable between an open position allowing access to the cartridge interface and a closed position blocking access to the cartridge interface. The washing toilet seat assembly further includes a cartridge removably coupled to the cartridge interface, the cartridge including a dispensable solution, and a spray wand moveably supported by at least one of the toilet seat or the housing. The spray wand is in fluid communication with the cartridge to dispense the dispensable solution, and the spray want is configured to dispense the dispensable solution during operation of the washing toilet seat assembly as a user sits on the toilet seat.

In another aspect, a washing toilet seat assembly includes a toilet seat and a housing configured to be coupled to a toilet bowl to support the toilet seat relative to the toilet bowl. The housing includes a cavity and a cartridge interface positioned within the cavity. The cartridge interface is configured to selectively receive a removable cartridge. The washing toilet seat assembly further includes a dispenser supported by at least one of the toilet seat or the housing. The dispenser is configured to dispense a solution from within the removable cartridge during operation of the washing toilet seat assembly as a user sits on the toilet seat.

In yet another aspect, a washing toilet seat assembly includes a toilet seat and a housing configured to be coupled to a toilet bowl to support the toilet seat about a pivot axis. The housing includes a cavity, a cartridge interface positioned within the cavity, and a cover positioned between portions of the toilet seat that enable the toilet seat to pivot relative to the housing. The cover is moveable between an open position allowing access to the cartridge interface and a closed position blocking access to the cartridge interface. The washing toilet seat assembly further includes a cartridge selectively coupled to the cartridge interface, the cartridge containing a dispensable solution, a first dispenser selectively movable relative to the toilet seat, the first dispenser configured to be in fluid communication with a water supply source to dispense water from the water supply source, and a second dispenser selectively movable relative to the toilet seat, the second dispenser in communication with the cartridge to dispense the dispensable solution.

In addition, other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
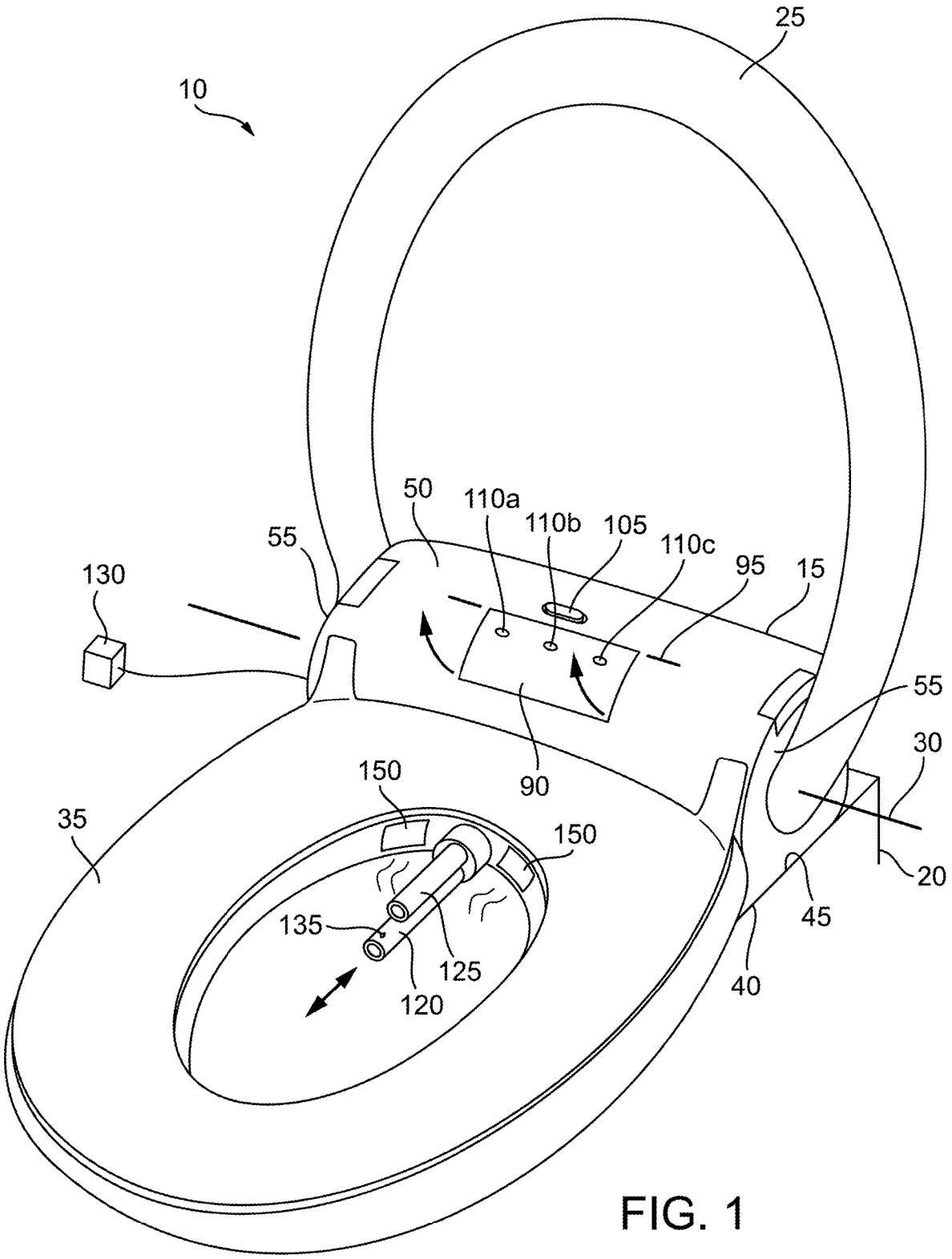
FIG. 1 is a perspective view of a washing toilet seat assembly according to one embodiment of the invention.

FIG. 1 illustrates a washing toilet seat assembly 10 including a housing 15 coupled to a toilet bowl 20, a toilet seat lid 25 pivotably coupled to the housing 15 about a pivot axis 30, and a toilet seat 35 also pivotably coupled to the housing 15 about the pivot axis 30. In other embodiments, the toilet seat lid 25 and the toilet seat 35 can pivot about different axes relative to the housing 15. In further embodiments, the toilet seat 35 can be fixed (e.g., non-pivotable) to the housing 15.

Figure 3:
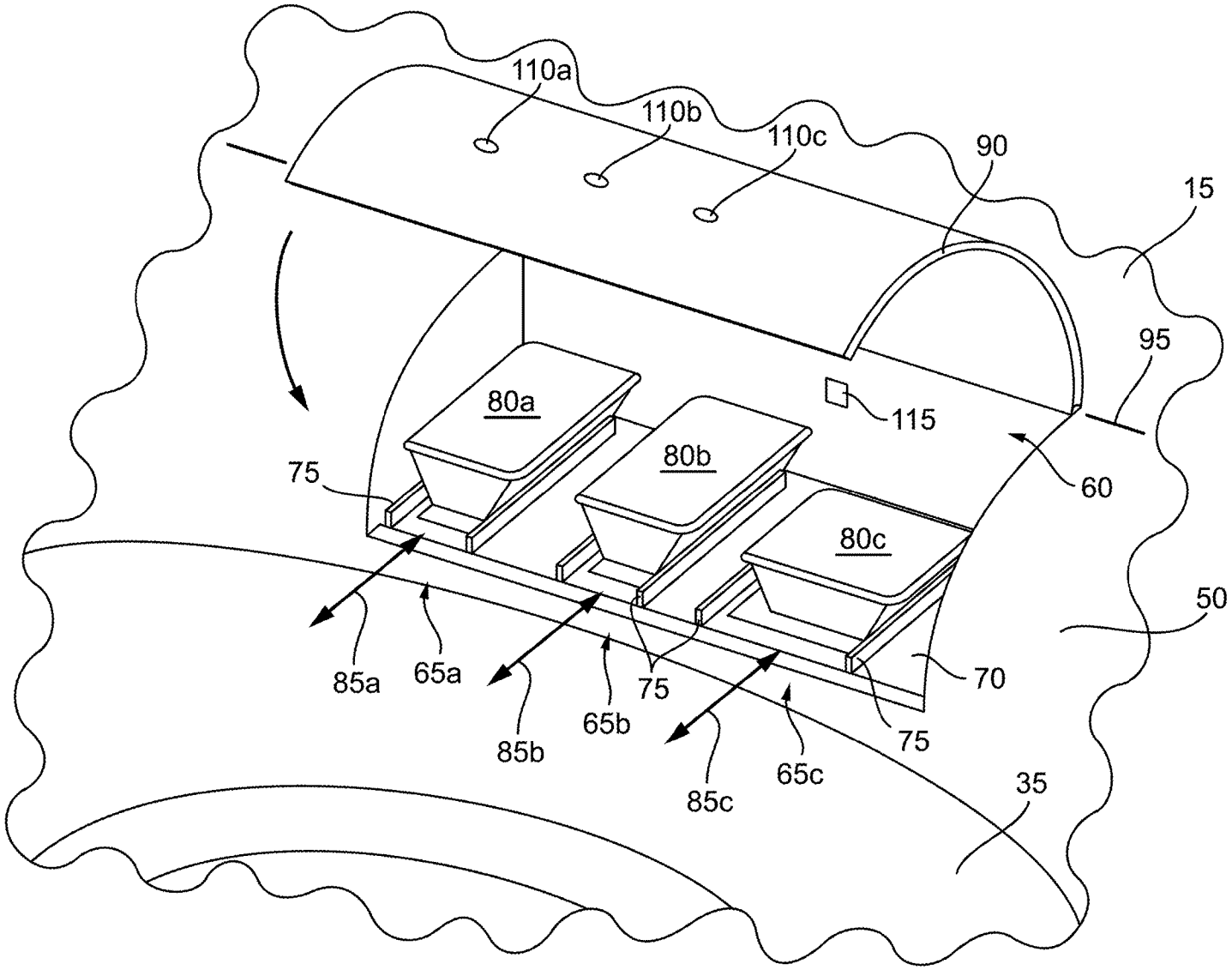
FIG. 3 is a perspective view of a portion of the housing including a plurality of cartridges coupled within the housing.

The illustrated housing 15 includes a bottom surface 40 contacting a bowl surface 45 of the toilet bowl 20, an upper surface 50 opposite the bottom surface 40, and side surfaces 55 for supporting the toilet seat lid 25 and the toilet seat 35 about the pivot axis 30. The housing 15 also includes a cavity 60 (FIG. 3) positioned centrally between the side surfaces 55 and rearwardly of the toilet seat 35 when the toilet seat 35 is in an operating position (FIG. 1). With reference to FIG. 3, cartridge interface structures 65*a*, 65*b*, 65*c* are coupled to a support surface 70 within the cavity 60. In the illustrated embodiment, the cavity 60 is a single cavity such that all of the cartridge interface structures 65*a*, 65*b*, 65*c* are positioned in the same cavity. The support surface 70 is substantially parallel to the bowl surface 45 of the toilet bowl 20. In the illustrated embodiment, each cartridge interface structure 65*a*, 65*b*, 65*c* includes a pair of rails 75 having a slot that slidably receives a cartridge 80*a*, 80*b*, 80*c* along an insertion axis 85*a*, 85*b*, 85*c*. Each insertion axis 85*a*, 85*b*, 85*c* is oriented transverse (e.g., non-parallel) to the pivot axis 30. Each insertion axis 85*a*, 85*b*, 85*c* is also parallel to the bowl surface 45 of the toilet bowl 20. As such, the cartridges 80*a*, 80*b*, 80*c* are front-loaded into the housing 15. In other embodiments, each insertion axis 85*a*, 85*b*, 85*c* can be oriented perpendicular to the pivot axis 30 or parallel to the pivot axis 30. For example, the cartridges 80*a*, 80*b*, 80*c* can be top-load into the housing 15 with the insertion axis 85*a*, 85*b*, 85*c* perpendicular to the bottom surface 40 of the housing 15. In further embodiments, the cartridge interface structures 65*a*, 65*b*, 65*c* can be differently configured to include hook-type mechanisms, snap-type mechanisms, twist-type mechanisms, etc. to couple the cartridges 80*a*, 80*b*, 80*c* to the housing 15. In yet further embodiments, the housing 15 can include more or less than three cartridge interface structures 65*a*, 65*b*, 65*c*.

Each illustrated cartridge 80*a*, 80*b*, 80*c* includes a dispensable solution. For example, the dispensable solution is medication (e.g., for hemorrhoids, etc.) or perfume/fragrance. In other embodiments, the dispensable solution can be a different solution desirable while using the washing toilet seat assembly 10.

With continued reference to FIG. 3, the cartridges 80*a*, 80*b*, 80*c* are coupled to the cartridge interface structures 65*a*, 65*b*, 65*c* in a particular orientation depending on the type of cartridge 80*a*, 80*b*, 80*c* (e.g., either a medicine cartridge 80*a*, 80*b* or a fragrance cartridge 80*c*). The medicine cartridge 80*a*, 80*b* is inserted into the cartridge interface structure 65*a*, 65*b* along the insertion axis 85*a*, 85*b* to couple the medicine cartridge 80*a*, 80*b* to the cartridge interface structure 65*a*, 65*b*. However, the fragrance cartridge 80*c* is inserted into the cartridge interface structure 65*c* along the insertion axis 85*c* and then further moved (e.g., rotated 90 degrees) to couple the fragrance cartridge 80*c* to the cartridge interface structure 65*c*. The cartridge interface structure 65*c* can expand or move to accommodate the further movement of the fragrance cartridge 80*c*. Accordingly, any one of the cartridges 80*a*, 80*b*, 80*c* can be coupled to the cartridge interface structures 65*a*, 65*b*, 65*c*, but the orientation of the cartridges 80*a*, 80*b*, 80*c* relative to the cartridge interface structures 65*a*, 65*b*, 65*c* signifies the type of cartridge 80*a*, 80*b*, 80*c* coupled to the cartridge interface structures 65*a*, 65*b*, 65*c*.

In other embodiments, the cartridges 80*a*, 80*b*, 80*c* and the cartridge interface structures 65*a*, 65*b*, 65*c* are constructed such that a particular cartridge 80*a*, 80*b*, 80*c* can only properly connect with a particular cartridge interface structure 65*a*, 65*b*, 65*c*. For example, the medication cartridge 80*a*, 80*b* can be different (e.g., in size, shape, configuration, type, etc.) relative to the fragrance cartridge 80*c* such that the medication cartridge 80*a*, 80*b* can only be coupled to the medication cartridge interface structure 65*a*, 65*b* and the fragrance cartridge 80*c* can only be coupled to the fragrance cartridge interface structure 65*c*. In other embodiments, the medication cartridge interface structure 65*a*, 65*b* can be different (e.g., in size, shape, configuration, type, etc.) to the fragrance cartridge interface structure 65*c* such that the medication cartridge 80*a*, 80*b* can only be coupled to the medication cartridge interface structure 65*a*, 65*b* and the fragrance cartridge 80*c* can only be coupled to the fragrance cartridge interface structure 65*c*.

Figure 2:
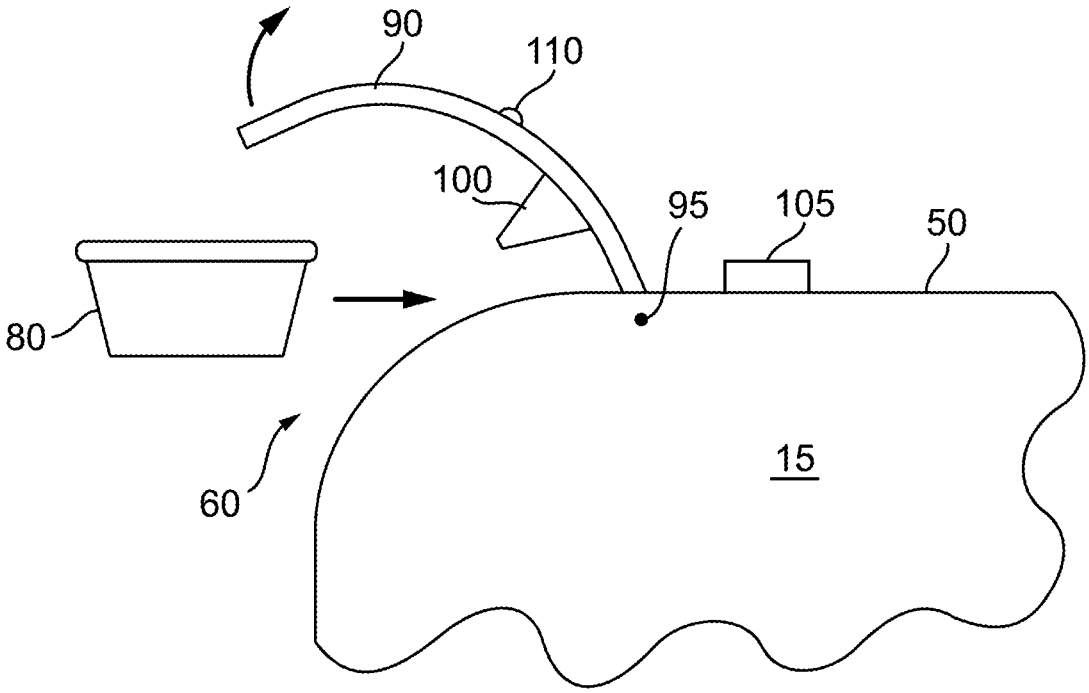
FIG. 2 is a side view of a portion of the washing toilet seat assembly illustrating a cartridge being inserted into a housing of the washing toilet seat assembly.

The housing 15 also includes a cover or door 90 coupled to the upper surface 50 between a closed position (FIG. 1) and an open position (FIGS. 2 and 3). In some embodiments, the cover 90 may form a water-tight seal with the rest of the housing 15 when in the closed position. The cover 90 is also positioned centrally between the side surfaces 55 of the housing 15. In the illustrated embodiment, the cover 90 is pivotably coupled to the housing 15 about a cover axis 95. The cover axis 95 may be generally parallel to the pivot axis 30 of the seat 35. In other embodiments, the cover 90 can be slidably coupled to the housing 15 between the closed and open positions. With reference to FIG. 2, the cover 90 includes a latch 100 that engages the housing 15 to hold the cover 90 in the closed position until a push button or actuator 105 is depressed thereby releasing the latch 100 allowing the cover 90 to move into the open position. In one embodiment, the cover 90 is biased by a spring into the open position when the push button 105 is depressed. Once in the open position (FIG. 3), the cover 90 allows access to the cartridge interface structures 65*a*, 65*b*, 65*c* and the cartridges 80*a*, 80*b*, 80*c*.

With reference to FIGS. 1 and 3, the illustrated housing 15 also includes indicators 110*a*, 110*b*, 110*c* each in communication with a control processor 115 of the washing toilet seat assembly 10. In particular, the cover 90 includes the indicators 110*a*, 110*b*, 110*c* and each indicator 110*a*, 110*b*, 110*c* aligns with a corresponding cartridge interface structure 65*a*, 65*b*, 65*c* such that each indicator 110*a*, 110*b*, 110*c* is easily associated with one cartridge interface structure 65*a*, 65*b*, 65*c*—and ultimately one cartridge 80*a*, 80*b*, 80*c* when the cartridge 80*a*, 80*b*, 80*c* is coupled to the cartridge interface structure 65*a*, 65*b*, 65*c*. In other embodiments, the indicators 110*a*, 110*b*, 110*c* can be spaced from the cover 90 and coupled to the upper surface 50 of the housing 15. In the illustrated embodiment, the indicators 110*a*, 110*b*, 110*c* are light sources (e.g., light emitting diodes) indicating a status of the cartridges 80*a*, 80*b*, 80*c* coupled to the housing 15. For example, the control processor 115 is configured to monitor an amount of dispensable solution within the cartridges 80*a*, 80*b*, 80*c* when the cartridges 80*a*, 80*b*, 80*c* are coupled to the cartridge interface structures 65*a*, 65*b*, 65*c* and indicate the amount via the indicators 110*a*, 110*b*, 110*c*. In the illustrated embodiment, the indicators 110*a*, 110*b*, 110*c* illuminate in a first color (e.g., green) when the amount of dispensable solution is greater than a determined amount (e.g., greater than about 20 percent) indicating a sufficient amount of dispensable solution within the cartridges 80*a*, 80*b*, 80*c*. In contrast, the indicators 110*a*, 110*b*, 110*c* illuminate in a second color (e.g., yellow) when the amount of dispensable solution is less than the determined amount (e.g., less than about 20 percent) indicating the cartridge 80*a*, 80*b*, 80*c* is low or empty and needs to be replaced soon. The indicators 110*a*, 110*b*, 110*c* may also illuminate a third color (e.g., red) when the corresponding cartridge 80*a*, 80*b*, 80*c* is empty or when a cartridge is not coupled to the corresponding cartridge interface structure 65*a*, 65*b*, 65*c*.

Figure 4:
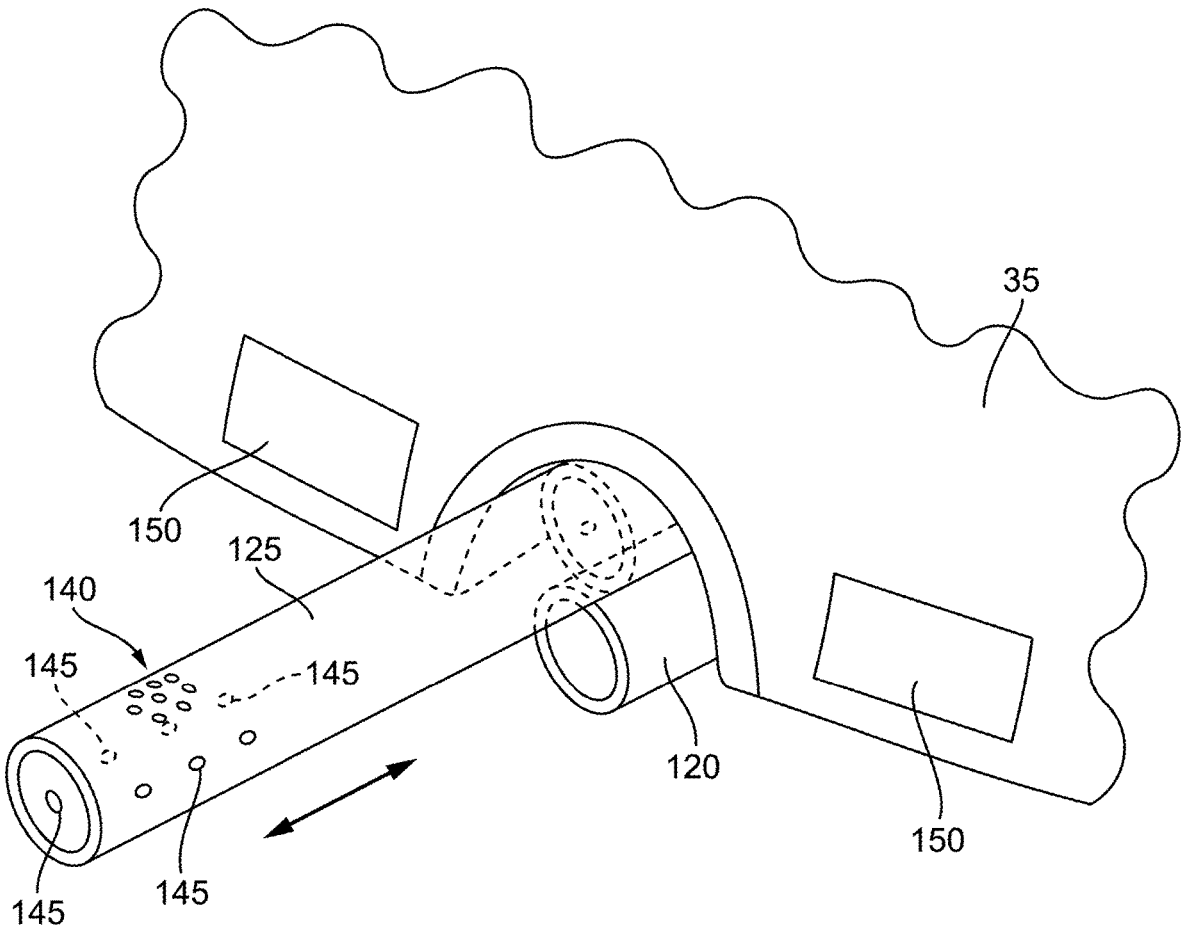
FIG. 4 is a perspective view of a portion of the washing toilet seat assembly including a washing dispenser, an auxiliary dispenser, and a plurality of dryers.
Figure 5:
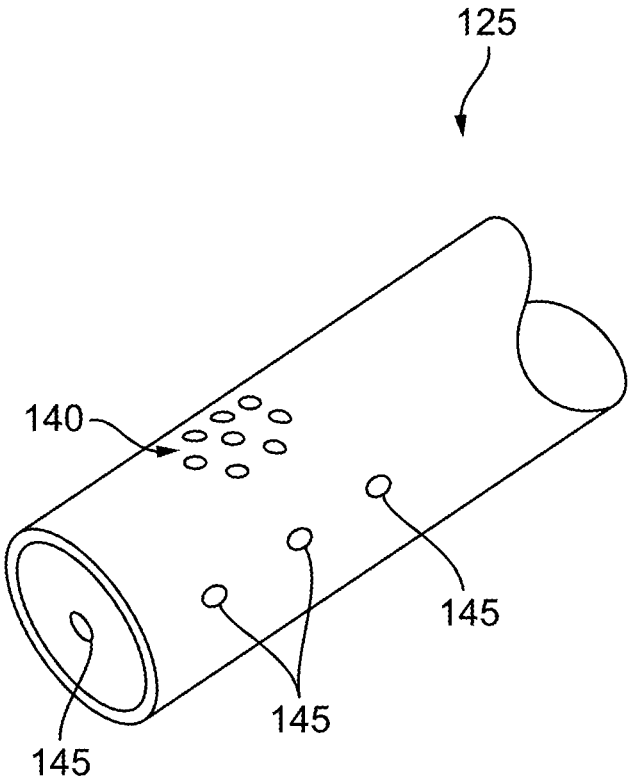
FIG. 5 is a detailed view of a portion of the auxiliary dispenser.

With reference to FIGS. 1, 4, and 5, the washing toilet seat assembly 10 also includes a first dispenser 120 (e.g., a washing wand) and a second dispenser 125 (e.g., an auxiliary wand). The illustrated second dispenser 125 is positioned above the first dispenser 120. Both the dispensers 120, 125 are selectively moveable relative to the toilet seat 35 (e.g., between at least five determined positions). In particular, both the dispensers 120, 125 are extendable and retractable relative to the toilet seat 35. In some embodiments, the first dispenser 120 moves with the second dispenser 125, and in other embodiments, the dispensers 120, 125 are moveable independently of each other. The illustrated first dispenser 120 is in fluid communication with a water supply source 130 and includes at least one washing aperture 135 adjacent an end of the first dispenser 120 to dispense water from the water supply source 130. The illustrated second dispenser 125 is fluidly coupled to the cartridge interface structures 65*a*, 65*b*, 65*c*—and ultimately in fluid communication with the cartridges 80*a*, 80*b*, 80*c* coupled to the cartridge interface structures 65*a*, 65*b*, 65*c*. The second dispenser 125 includes a group/cluster of medication apertures 140 formed in an end of the second dispenser 125 and facing upwardly. The second dispenser 125 also includes fragrance apertures 145 positioned on the side of the second dispenser 125.

In particular, the medication apertures 140 are fluidly coupled to each cartridge interface structure 65*a*, 65*b*, 65*c*, and the fragrance apertures 145 are also fluidly coupled to each cartridge interface structure 65*a*, 65*b*, 65*c*. As such, the second dispenser 125 is operable to dispense medication in any medication cartridge 80 coupled to the cartridge interface structures 65*a*, 65*b*, 65*c* through the medication apertures 140, and the second dispenser 125 is operable to dispense fragrance in any fragrance cartridge 80 coupled to the cartridge interface structures 65*a*, 65*b*, 65*c* through the fragrance apertures 145. The medication apertures 140 and the fragrance apertures 145 are fluidly isolated from each other such that cross-contamination is prevented between medication and fragrance applications. For example, the control processor 115 identifies an orientation of the cartridges 80 coupled to the cartridge interface structures 65*a*, 65*b*, 65*c*, and if all of the cartridges 80 are medication cartridges, the control processor 115 is then operable to selectively dispense any one of the medications (or a mixture of medications) through the medication apertures 140. Alternatively, if all or some of the cartridges 80 are fragrance cartridges, the control processor 115 is then operable to selectively dispense any one of the fragrances through the fragrance apertures 145.

In some embodiments, the medication apertures 140 are fluidly coupled to only some of the cartridge interface structures 65*a*, 65*b*, 65*c*, and the fragrance apertures 145 are fluidly coupled to only the remaining cartridge interface structures 65*a*, 65*b*, 65*c*. Again, the medication apertures 140 and the fragrance apertures 145 are fluidly isolated from each other. For example, the medication apertures 140 are only fluidly coupled to the two cartridge interface structures 65*a*, 65*b*, and the fragrance apertures 145 are only fluidly coupled to the third cartridge interface structure 65*c*. As such, only medication cartridges 80*a*, 80*b* are coupled to the cartridge interface structures 65*a*, 65*b* for the control processor 115 to selectively dispense the medication from the medication apertures 140, and only the fragrance cartridge 80*c* is coupled to the cartridge interface structure 65*c* for the control processor 115 to selectively dispense the fragrance from the fragrance apertures 145.

In the illustrated embodiment, the dispensers 120, 125 are coupled to the housing 15 such that the toilet seat 35 pivots relative to the dispensers 120, 125. In other embodiments, the dispensers 120, 125 are coupled to the toilet seat 35 to move with the toilet seat 35. In addition, the washing toilet seat assembly 10 includes dryers 150 positioned on opposite sides of the dispensers 120, 125. The dryers 150 are operable to produce warm, drying air during operation. In the illustrated embodiment, the washing toilet seat assembly 10 includes two dryers 150. In other embodiments, the washing toilet seat assembly 10 may include fewer or more dryers 150, and/or the dryers 150 may be located elsewhere relative to the dispensers 120, 125.

Figure 6:
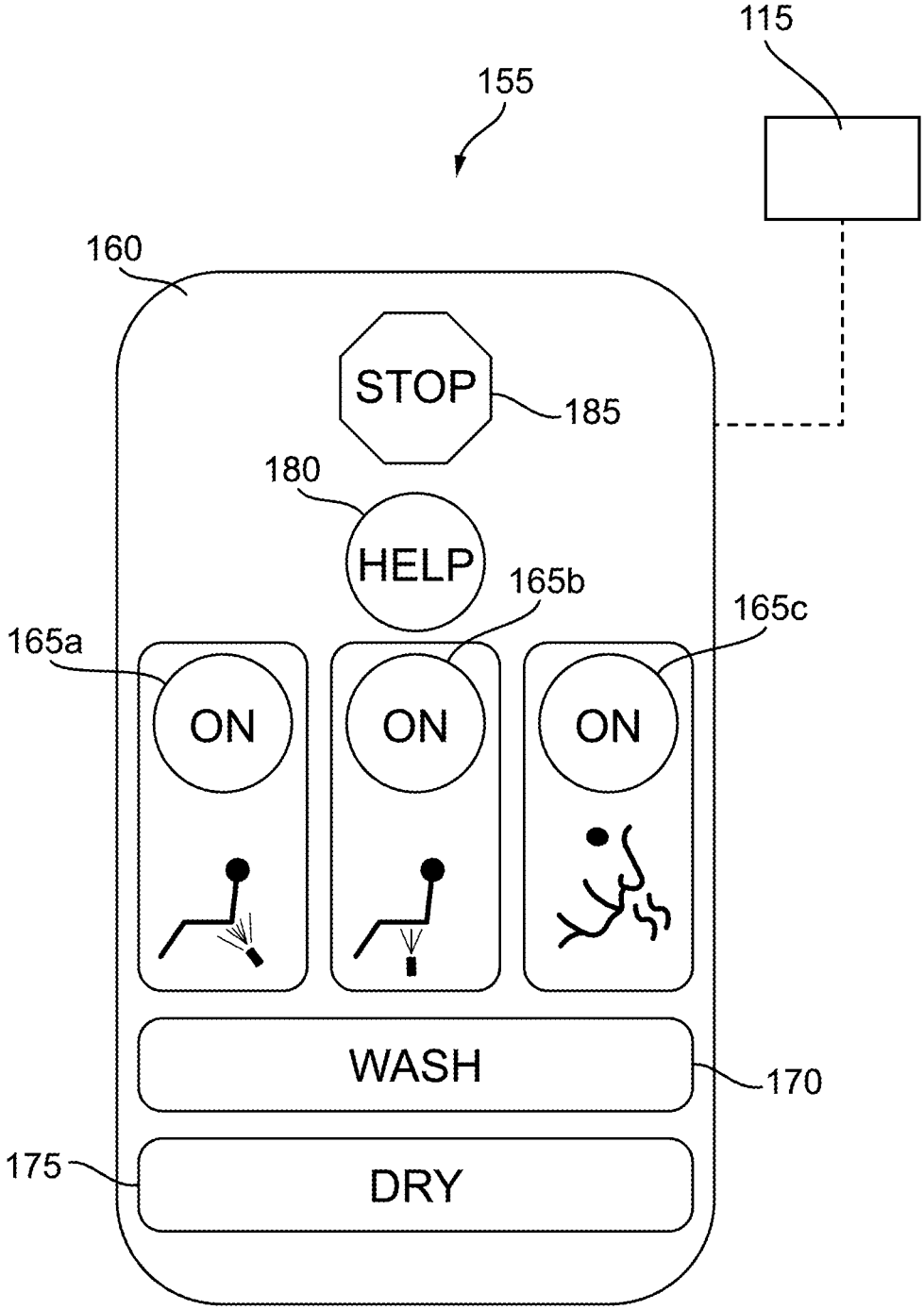
FIG. 6 illustrates a remote device operable to control the washing toilet seat assembly.

FIG. 6 illustrates an electronic device 155, or remote device, in communication with the control processor 115 and operable to control the washing toilet seat assembly 10. The electronic device 155, in one embodiment, is a small electronic device (e.g., a tablet, smartphone, etc.) including software that controls the number of 'buttons' that appear on a display 160 of the electronic device 155 and are 'pushed' to start or stop a function of the washing toilet seat assembly 10. The display 160 can be changed from very basic function control to full feature function control by making appropriate selections in the software setup. Font size can also be changed to make it easier for someone with limited vision to more easily see the basic function controls.

The illustrated electronic device 155 includes a set of start buttons 65*a*, 65*b*, 65*c* each associated with one cartridge interface structure 65*a*, 65*b*, 65*c*. For example, the first start button 165*a* is operable to extend the second dispenser 125 relative to the toilet seat 35 and to dispense a first medication within the first medication cartridge 80*a* to the user of the washing toilet seat assembly 10. The second start button 165*b* is operable to also extend the second dispenser 125 relative to the toilet seat 35, but dispenses a second medication supported within the second medication cartridge 80*b* to the user. The third start button 165*c* is operable to again extend the second dispenser 125 relative to the toilet seat 35, but dispenses fragrance supported within the fragrance cartridge 80*c* to the user. In one embodiment, the second dispenser 125 can automatically retract relative to the toilet seat 35 after a determined period of time after the corresponding start button 65*a*, 65*b*, 65*c* has been depressed. The electronic device 155 can also include controls to adjust a spray or misting characteristic of the medicine/fragrance being dispensed from the second dispenser 125.

The illustrated electronic device 155 also includes a washing button 170 operable to extend the first dispenser 120 relative to the toilet seat 35 to dispense the water from the water supply source 130, a drying button 175 to operate the dryers 150, an assistance button 180 operable to alert for help if the user requires assistance using, standing up from, or sitting down on the washing toilet seat assembly 10, and a stop button 185 that manually stops various functions of the washing toilet seat assembly 10 (e.g., stops the washing fluid from being dispensed from the first dispenser 120, stops medicine/fragrance from being dispensed from the second dispenser 125, stops the dryers 150, etc.). In addition, the electronic device 155 includes programs for different applications of the washing toilet seat assembly 10. For example, the electronic device 155 includes a first program to operate the first dispenser 120 (the washing dispenser) for a determined or adjustable period of time, a second program to operate the second dispenser 125 to dispense medication for another determined or adjustable period of time, a third program to operate the second dispenser 125 to dispense fragrance for yet another determined or adjustable period of time, etc. The electronic device 155 can also include a self-clean button utilizing ultraviolet light and/or sanitized water to clean the washing toilet seat assembly 10.

Figure 7:
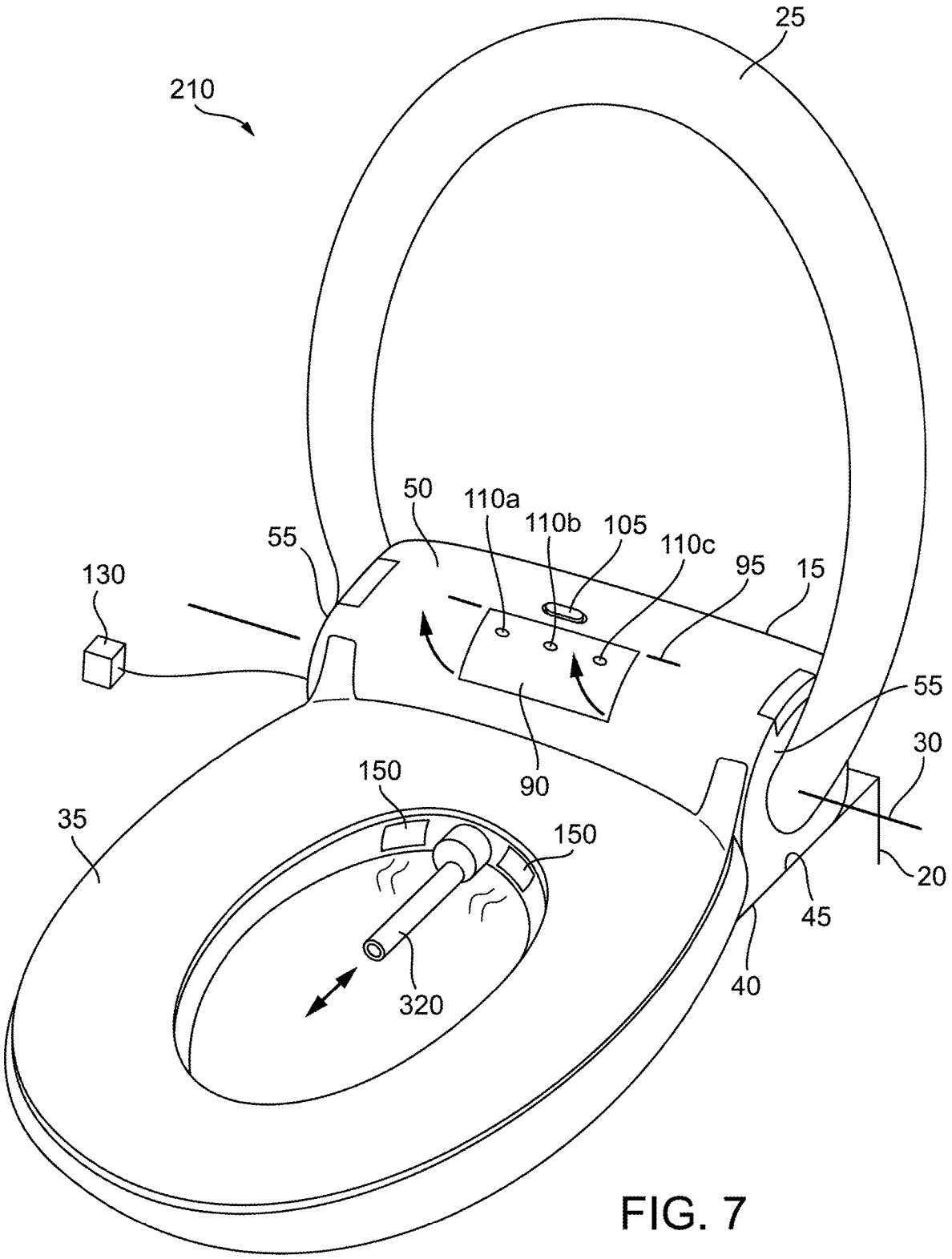
FIG. 7 is a perspective view of a washing toilet seat assembly according to another embodiment of the invention.
Figure 8:
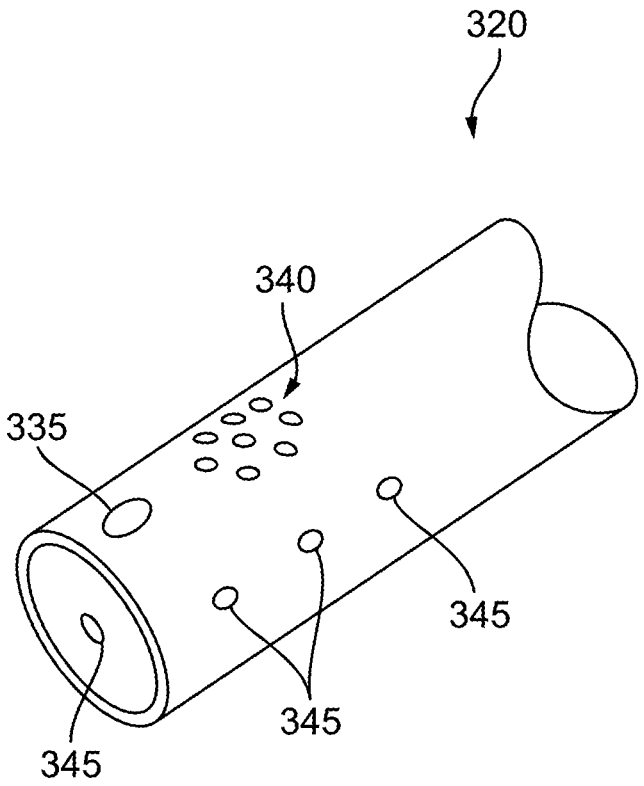
FIG. 8 is a detailed view of a portion of a dispenser of the washing toilet seat assembly of FIG. 7.

FIGS. 7 and 8 illustrate a washing toilet seat assembly 210 according to another embodiment. The washing toilet seat assembly 210 is similar to the washing toilet seat assembly 10; therefore, similar components are designated with similar references numbers each incremented by 200. At least some differences and/or at least some similarities between the washing toilet seat assemblies 10, 210 will be discussed in detail below. In addition, components or features described with respect to only one or some of the embodiments described herein are equally applicable to any other embodiments described herein.

The washing toilet seat assembly 210 includes a single dispenser 320 having at least one washing aperture 335, a group of medication apertures 340, and a group of fragrance apertures 345. The washing aperture 335 is in fluid communication with the water supply source 130, and the medication apertures 340 and the fragrance apertures 345 are in fluid communication with the cartridge interface structures 65*a*, 65*b*, 65*c* and ultimately the cartridges 80*a*, 80*b*, 80*c*. The washing toilet seat assembly 210 simply includes one dispenser 320 (rather than two dispensers 120, 125 of the washing toilet seat assembly 10) to selectively dispense water, medication, and/or fragrance from the single dispenser 320.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A washing toilet seat assembly comprising:

a toilet seat;

a housing configured to be coupled to a toilet bowl to support the toilet seat about a pivot axis, the housing including a cartridge interface and a cover moveable between an open position allowing access to the cartridge interface and a closed position blocking access to the cartridge interface;

a cartridge removably coupled to the cartridge interface, the cartridge including a dispensable solution; and a spray wand moveably supported by at least one of the toilet seat or the housing, the spray wand in fluid communication with the cartridge to dispense the dispensable solution, the spray wand configured to dispense the dispensable solution during operation of the washing toilet seat assembly as a user sits on the toilet seat.

2. The washing toilet seat assembly of claim 1, wherein the dispensable solution is a medication.

3. The washing toilet seat assembly of claim 1, wherein the spray wand includes a first dispenser and a second dispenser, and wherein the second dispenser is fluidly isolated from the first dispenser.

4. The washing toilet seat assembly of claim 3, wherein the second dispenser is in fluid communication with the cartridge.

5. The washing toilet seat assembly of claim 1, wherein the housing includes a first indicator representing an amount of the dispensable solution within the cartridge.

6. The washing toilet seat assembly of claim 5, wherein the indicator includes a light source coupled to the cover of the housing, and wherein the indicator is in alignment with the cartridge when the cover is in the open position.

7. The washing toilet seat assembly of claim 1, wherein the cartridge is inserted into the cartridge interface along an insertion axis transverse to the pivot axis of the toilet seat.

8. The washing toilet seat assembly of claim 1, wherein the housing includes a cavity, wherein the cartridge interface is positioned within the cavity, and wherein the cover selectively covers the cavity.

9. The washing toilet seat assembly of claim 8, wherein the cover forms a water- tight seal about the cavity when in the closed position.

10. A washing toilet seat assembly comprising:

a toilet seat;

a housing configured to be coupled to a toilet bowl to support the toilet seat relative to the toilet bowl, the housing including a cavity and a cartridge interface positioned within the cavity, the cartridge interface configured to selectively receive a removable cartridge; and a spray wand supported by at least one of the toilet seat or the housing, the spray wand configured to dispense a solution from within the removable cartridge during operation of the washing toilet seat assembly as a user sits on the toilet seat.

11. The washing toilet seat assembly of claim 10, wherein the spray wand is a first spray wand, and wherein the washing toilet seat assembly includes a second spray wand configured to be in communication with a water supply source to dispense water from the water supply source.

12. The washing toilet seat assembly of claim 11, wherein the second spray wand is fluidly isolated from the first spray wand.

13. The washing toilet seat assembly of claim 10, wherein the spray wand includes a first aperture configured to be in fluid communication with a water supply source and a second aperture configured to be in fluid communication with the cartridge, and wherein the first aperture and the second aperture are fluidly isolated relative to each other.

14. The washing toilet seat assembly of claim 10, wherein the spray wand is movable relative to the toilet seat between an extended position and a retracted position.

15. The washing toilet seat assembly of claim 10, wherein the spray wand is supported by the toilet seat to move with the toilet seat relative to the housing.

16. A washing toilet seat assembly comprising:

a toilet seat;

a housing configured to be coupled to a toilet bowl to support the toilet seat about a pivot axis, the housing including a cavity, a cartridge interface positioned within the cavity, and a cover positioned between portions of the toilet seat that enable the toilet seat to pivot relative to the housing, the cover moveable between an open position allowing access to the cartridge interface and a closed position blocking access to the cartridge interface;

a cartridge selectively coupled to the cartridge interface, the cartridge containing a dispensable solution configured to be dispensed during operation of the washing toilet seat assembly as a user sits on the toilet seat;

a first dispenser selectively movable relative to the toilet seat, the first dispenser configured to be in fluid communication with a water supply source to dispense water from the water supply source; and a spray wand selectively movable relative to the toilet seat, the spray wand in communication with the cartridge to dispense the dispensable solution.

17. The washing toilet seat assembly of claim 16, wherein the first dispenser and the spray wand are independently movable.

18. The washing toilet seat assembly of claim 16, wherein the first dispenser and the spray wand are fluidly isolated.

19. The washing toilet seat assembly of claim 16, further comprising a dryer configured to produce drying air, the dryer positioned adjacent the first dispenser or the spray wand.

20. The washing toilet seat assembly of claim 16, wherein the dispensable solution is a medication.

* * * * *